US006495955B1

(12) United States Patent
Forbes et al.

(10) Patent No.: US 6,495,955 B1
(45) **Date of Patent: *Dec. 17, 2002**

(54) STRUCTURE AND METHOD FOR IMPROVED FIELD EMITTER ARRAYS

(75) Inventors: Leonard Forbes, Corvallis, OR (US); Kie Y. Ahn, Chappaqua, NY (US)

(73) Assignee: Micron Technology, Inc., Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/695,632

(22) Filed: Oct. 24, 2000

Related U.S. Application Data

(63) Continuation of application No. 09/144,207, filed on Sep. 1, 1998, now Pat. No. 6,232,705.

(51) Int. Cl.[7] ..... H01J 1/304; H01J 19/24

(52) U.S. Cl. ..... 313/495; 313/309; 313/336; 313/351

(58) Field of Search ..... 313/309, 336, 313/351, 495

(56) References Cited

U.S. PATENT DOCUMENTS

| | | | | |
|---|---|---|---|---|
| 3,665,241 | A | 5/1972 | Spindt et al. | 313/351 |
| 3,755,704 | A | 8/1973 | Spindt et al. | 313/309 |
| 3,812,559 | A | 5/1974 | Spindt et al. | 29/25.18 |
| 5,186,670 | A | 2/1993 | Doan et al. | 445/24 |
| 5,229,331 | A | 7/1993 | Doan et al. | 437/228 |
| 5,259,799 | A | 11/1993 | Doan et al. | 445/24 |
| 5,358,908 | A | 10/1994 | Reinberg et al. | 437/228 |
| 5,372,973 | A | 12/1994 | Doan et al. | 437/228 |
| 5,597,444 | A | 1/1997 | Gilton | 156/643.1 |
| 5,653,619 | A | 8/1997 | Cloud et al. | 445/24 |
| 5,853,492 | A | 12/1998 | Cathey et al. | 134/3 |
| 6,232,705 | B1 * | 5/2001 | Forbes et al. | 313/309 |

OTHER PUBLICATIONS

Huq, S.E., et al., "Fabrication of Gated Polycrystalline Silicon Field Emitters", 9th International Vacuum Microelectrics Conference, St. Petersburg, pp. 367–370, (1996) (No month).

Kim, H., et al., "Metal FEA's on Double Layer Structure of Polycrystalline Silicon", 9th International Vacuum Microelectronics Conference, St. Petersburg, pp. 423–426, (1996) (No month).

Kim, I.H., et al., "Fabrication of metal field emitter arrays on polycrystalline silicon", *J. Vac. Sci. Technol. B* 15(2), pp. 468–471, (1997) (No month).

Lazarouk, S., et al., "Electrical characterization of visible emitting electroluminescent Schottky diodes based on n–type porous silicon and on highly doped n–type porous polysilicon", *Journal of Non–Crystalline Solids*, pp. 973–976, (1996) (No month).

Lee, J.H., et al., "A New Fabrication Method of Silicon Field Emitter Array with Local Oxidation of Polysilicon and Chemical–Mechanical–Polishing", 9th International Vacuum Microelectronics Conference, St Petersburg, pp. 415–418, (1996).

(List continued on next page.)

*Primary Examiner*—Michael H. Day
*Assistant Examiner*—Joseph Williams
(74) *Attorney, Agent, or Firm*—Schwegman, Lundberg, Woessner & Kluth, P.A.

(57) ABSTRACT

A method and structure are provided for simultaneously fabricating polysilicon cones for a field emitter and a porous insulating oxide layer for supporting a gate material. The porous insulating oxide is fabricated by first making the polysilicon porous in the field regions by an anodic etch and then oxidation. This is a fully self-aligned process and only one masking is used. Shaping of the gate material in close proximity to the top of the cone is achieved by a lift-off technique and requires no special deposition techniques like depositions at a grazing incidence to improve the emitter.

28 Claims, 7 Drawing Sheets

OTHER PUBLICATIONS

Pullen, S.E., et al., "Enhanced Field Emission from Polysilicon Emitters Using Porous Silicon", 9th International Vacuum Microelectronics Conference, St Petersburg, pp. 211–214, (1996) (No month).

Uh, H.S., et al., "Enhanced Electron Emission and Its Stability from Gated Mo–polycide Field Emitters", *IEEE*, pp. 713–716, (1997) (No month).

Uh, H.S., et al., "Fabrication and Characterization of Gated n Polycrystalline Silicon Field Emitter Array", 9th International Vacuum Microelectronics Conference, St. Petersburg, pp. 419–422, (1996) (No month).

Uh, H.S. et al., "Process design and emission properties of gated n polycrystalline silicon field emitter arrays for flat–panel display applications", *J. Vac. Sci. Technol. B* 15)2), pp. 472–476, (1997) (No month).

Anderson, R.C., et al., "Porous Polycrystalline Silicon: A New Material for MEMS", *IEEE*, pp. 10–18, (1994) (No month).

Boswell, E.C., et al., "Polycrystalline Silicon Field Emitters", 8th International Vacuum Microelectronics Conference Technical Digest, pp. 181–185, (1996) (No month).

Boswell, E.C., et al., "Polycrystalline Silicon Field Emitters", *J. Vac. Sci. Technol. B* 14(3), pp. 1910–1913, (1996) (No month).

Huang, W.N., et al., "Photoluminescence in porous sputtered polysilicon films formed by chemical etching", *Semicond. Sci. Technol.*, 12, pp. 228–233, (1997) (No month).

Huang, W.N., et al. "Properties of chemically etched porous polycrystalline silicon deposited by r.f. sputtering", IEEE Hong Kong Electron Devices Meeting, pp. 21–24, (1996) (No month).

Huq, S.E., et al., "Comparative study of gated single crystal silicon and polysilicon field emitters", *J. Vac. Sci. Technol. B* 15(6), pp. 2855–2858, (1997) (No month).

* cited by examiner

STRUCTURE AND METHOD FOR IMPROVED FIELD EMITTER ARRAYS

This application is a continuation of U.S. Ser. No. 09/144,207 filed on Sep. 1, 1998 now U.S. Pat. No. 6,232,705.

FIELD OF THE INVENTION

The present invention relates generally to semiconductor integrated circuits. More particularly, it pertains to a structure and method for improved field emitter arrays.

BACKGROUND OF THE INVENTION

Recent years have seen an increased interest in field emitter displays. This is attributable to the fact that such displays can fulfill the goal of consumer affordable hang-on-the-wall flat panel television displays with diagonals in the range of 20 to 60 inches. Certain field emitter displays, or flat panel displays, operate on the same physical principle as fluorescent lamps. A gas discharge generates ultraviolet light which excites a phosphor layer that fluoresces visible light. Other field emitter displays operate on the same physical principals as cathode ray tube (CRT) based displays. Excited electrons are guided to a phosphor target to create a display. Silicon based field emitter arrays are one source for creating similar displays.

Single crystalline structures have been under investigation for some time. However, large area, TV size, displays are likely to be expensive and difficult to manufacture from single crystal silicon wafers. Polycrystalline silicon, on the other hand, provides a viable substitute to single crystal silicon since it can be deposited over large areas on glass or other substrates.

Polysilicon field emitter devices have been previously described for flat panel field emission displays. But such field emitters have only been produced according to lengthy, conventional, integrated circuit technology, e.g., by masking polysilicon and then either etching or oxidation to produce cones of polysilicon with points for field emitters. The cones of polysilicon can then be utilized directly or undergo further processing to cover the points with some inert metal or low work function material.

Thus, it is desirable to develop a method and structure for large population density arrays of field emitters without compromising the responsiveness and reliability of the emitter. Likewise, it is desirable to obtain this result through an improved and streamlined manufacturing technique.

SUMMARY OF THE INVENTION

The above mentioned problems with field emitter arrays and other problems are addressed by the present invention and will be understood by reading and studying the following specification. A structure and method are described which accord these benefits.

In particular, an illustrative embodiment of the present invention includes a field emitter device on a substrate. The field emitter device includes a cathode formed in a cathode region of the substrate. A gate insulator is formed in an insulator region of the substrate. The gate insulator and the cathode are formed from a single layer of polysilicon by using a self-aligned technique. A gate is formed on the gate insulator. Further, an anode opposes the cathode.

In another embodiment, a field emitter device on a substrate is provided. The device includes a cathode formed in a cathode region of the substrate. The cathode consists of a polysilicon cone. A porous oxide layer is formed in an insulator region of the substrate. The porous oxide layer and the polysilicon cone are formed from a single layer of polysilicon by using a self-aligned technique. A gate is formed on the porous oxide layer. Further, the gate and the polysilicon cone are formed using the self-aligned technique. An anode opposes the cathode.

In another embodiment of the present invention, a field emitter array is provided. The array includes a number of cathodes which are formed in rows along a substrate. A gate insulator is formed along the substrate and surrounds the cathodes. The gate insulator material and the cathodes are formed from a single layer of polysilicon by using a self-aligned technique. A number of gate lines are formed on the gate insulator. Further, a number of anodes are formed in columns orthogonal to and opposing the rows of cathodes.

In another embodiment of the present invention, a flat panel display is provided. The flat panel display includes a field emitter array formed on a glass substrate. The field emitter array includes a number of cathodes formed in rows along the substrate. The number of cathodes are formed of polysilicon cones. A gate insulator is formed along the substrate and surrounds the cathodes. The gate insulator material and the cathodes are formed from a single layer of polysilicon by using a self-aligned technique. A number of gate lines formed on the gate insulator. Further the array has a number of anodes formed in columns orthogonal to, and opposing, the rows of cathodes. The anodes include multiple phosphors, and the intersection of the rows and columns form pixels. Further, the display includes a row decoder and a column decoder each coupled to the field emitter array in order to selectively access the pixels. A processor is included which is adapted to receiving input signals and providing the input signals to the row and column decoders in order to access the pixels.

In another embodiment, a method for forming a field emitter device on a substrate is provided. The method includes forming a polysilicon cone on the substrate. A porous oxide layer is formed on the substrate. The method includes forming the porous oxide layer and the polysilicon cone from a single layer of polysilicon using a self-aligned technique. A gate layer is formed on the porous oxide layer. Further, the polysilicon cone is isolated from the gate. And, an anode is formed opposite the cathode.

Thus, an improved method and structure are provided for simultaneously fabricating polysilicon cones for a field emitter and a porous insulating oxide layer for supporting a gate material. The porous insulating oxide is fabricated by first making the polysilicon porous in the field regions by an anodic etch and then oxidation. This is a fully self-aligned process and only one masking is used. Shaping of the gate material in close proximity to the top of the cone is achieved by a lift-off technique and requires no special deposition techniques like depositions at a grazing incidence to improve the emitter shape.

These and other embodiments, aspects, advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentalities, procedures, and combinations particularly pointed out in the appended claims.

DETAILED DESCRIPTION

Figure 1:
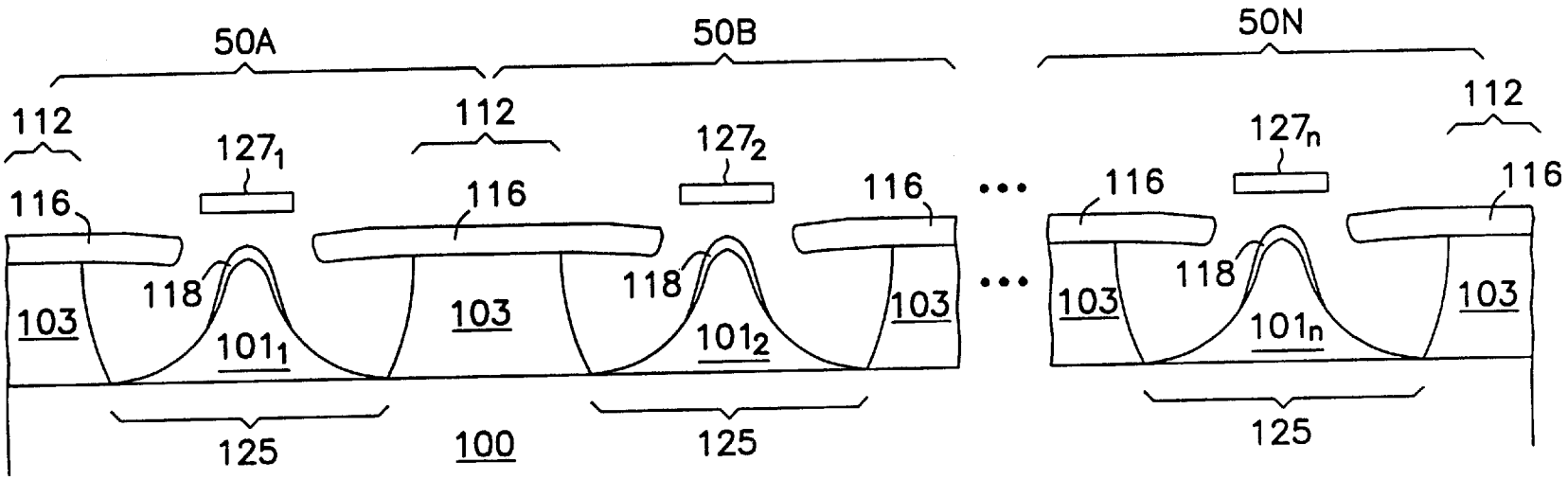
FIG. 1 is a planar view of an embodiment of a portion of an array of polysilicon field emitters according to the teachings of the present invention.

In the following detailed description of the invention, reference is made to the accompanying drawings which form a part hereof, and in which is shown, by way of illustration, specific embodiments in which the invention may be practiced. In the drawings, like numerals describe substantially similar components throughout the several views. These embodiments are described in sufficient detail to enable those skilled in the art to practice the invention. Other embodiments may be utilized and structural, logical, and electrical changes may be made without departing from the scope of the present invention.

The terms wafer and substrate used in the following description include any structure having an exposed surface with which to form the integrated circuit (IC) structure of the invention. The term substrate is understood to include semiconductor wafers. The term substrate is also used to refer to semiconductor structures during processing, and may include other layers that have been fabricated thereupon. Both wafer and substrate include doped and undoped semiconductors, epitaxial semiconductor layers supported by a base semiconductor or insulator, as well as other semiconductor structures well known to one skilled in the art. The term conductor is understood to include semiconductors, and the term insulator is defined to include any material that is less electrically conductive than the materials referred to as conductors. The following detailed description is, therefore, not to be taken in a limiting sense, and the scope of the present invention is defined only by the appended claims, along with the full scope of equivalents to which such claims are entitled.

The term "horizontal" as used in this application is defined as a plane parallel to the conventional plane or surface of a wafer or substrate, regardless of the orientation of the wafer or substrate. The term "vertical" refers to a direction perpendicular to the horizontal as defined above. Prepositions, such as "on", "side" (as in "sidewall"), "higher", "lower", "over" and "under" are defined with respect to the conventional plane or surface being on the top surface of the wafer or substrate, regardless of the orientation of the wafer or substrate.

FIG. 1 is a planar view of an embodiment of a portion of an array of field emitter devices, 50A, 50B, 50C, . . . 50D, and constructed according to the teachings of the present invention. The field emitter array 50 includes a number of cathodes, $\mathbf{101}_1$, $\mathbf{101}_2$, $\mathbf{101}_3$, . . . $\mathbf{125}_n$ formed in rows along a substrate 100. A gate insulator 103 is formed along the substrate 100 and surrounds the cathodes. A number of gate lines are on the gate insulator. A number of anodes, $\mathbf{127}_1$, $\mathbf{127}_2$, $\mathbf{127}_3$, . . . $\mathbf{127}_n$ are formed in columns orthogonal to and opposing the rows of cathodes. The anodes include multiple phosphors. And, the intersection of the rows and columns form pixels.

Each field emitter device in the array, 50A, 50B, . . . , 50N, is constructed in a similar manner. Thus, only one field emitter device 50N is described herein in detail. All of the field emitter devices are formed along the surface of a substrate 100. In one embodiment, the substrate includes a doped silicon substrate 100. In an alternate embodiment, the substrate is a glass substrate 100, including silicon dioxide ($SiO_2$). Field emitter device 50N includes a cathode 101 formed in a cathode region 125 of the substrate 100. The cathode 101 includes a polysilicon cone 101. In one exemplary embodiment, the polysilicon cone 101 includes a metal silicide 118 on the polysilicon cone 101. The metal silicide can include any one from a number of refractory metals, e.g. molybdenum (Mo), tungsten (W), or titanium (Ti), which has been deposited on the polysilicon cone 101, such as by chemical vapor deposition (CVD), and then undergone a rapid thermal anneal (RTA) to form the silicide. A gate insulator 103 is formed in an isolator region 112 of the substrate 100. The gate insulator 103 is a porous oxide layer 103. And, the polysilicon cone 101 and the porous oxide layer 103 have been formed from a single layer of polysilicon using a self-aligned technique. The porous oxide layer 103 results from performing an anodic etch on the polysilicon layer to first form a porous polysilicon layer. Next the porous polysilicon is oxidized to form the finished porous oxide layer 103. As will be explained below, the polysilicon cone 101 and the porous oxide layer 103 are fabricated simultaneously.

A gate 116 is formed on the gate insulator 103. In one embodiment, the gate 116 is formed of molybdenum (Mo). In an alternate embodiment, the gate 116 is formed of other suitable conductor, e.g. tungsten (W), or titanium (Ti). The gate 116 and the polysilicon cone 101 are formed using a self-aligned technique which is discussed below in connection with fabricating a field emitter device. An anode 127 opposes the cathode 102.

Figure 2A:
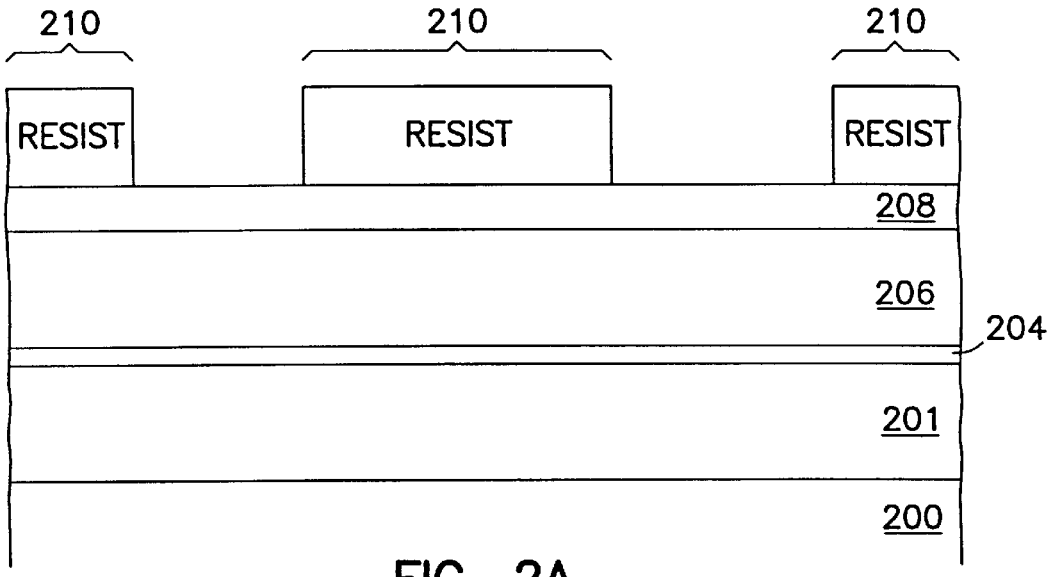
FIGS. 2A–2G illustrate an embodiment of a process of fabrication of a field emitter device according to the teachings of the present invention.

FIGS. 2A–2G illustrate an embodiment of a process of fabrication for a field emitter device according to the teachings of the present invention. FIG. 2A illustrates the structure following the first series of processing steps. A polysilicon layer 201 is deposited over a large area substrate 200. In one embodiment, the substrate includes a doped silicon layer. In an alternative embodiment, the substrate includes an insulator layer, e.g., silicon dioxide ($SiO_2$). The polysilicon layer 201 may be deposited using any suitable technique such as, for example, chemical vapor deposition (CVD). The polysilicon layer 201 is deposited to a thickness of approximately 1.0 micrometers ($\mu$m). The polysilicon layer 201 is then oxidized using a plasma assisted process, such as CVD, to form a thin oxide layer 204. The thin oxide layer 204 has a thickness of approximately 10 to 50 nanometers (nm). A thick silicon nitride ($Si_3N_4$) layer 206 is deposited on the oxide layer 204 using any suitable process. Again, one suitable technique includes CVD. The nitride layer 206 is deposited to a thickness of approximately 1.0 $\mu$m. A thick oxide layer 208 is deposited on the nitride layer 206. The oxide layer 208 is deposited using a CVD process. A photoresist is applied and exposed to define a mask 210 over a cathode region 225 of the substrate 200. The structure is now as appears in FIG. 2A.

Figure 2B:
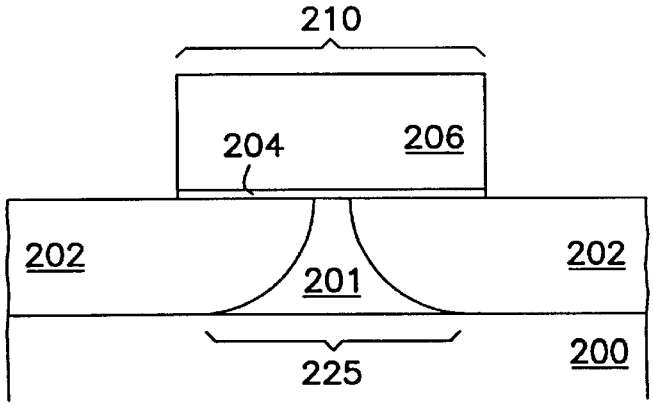

FIG. 2B illustrates the structure after the next sequence of fabrication steps. The composite oxide-nitride-oxide (ONO) is then etched using any suitable technique such as, for example, reactive ion etching (RIE). This etching process produces a mask 210 with a diameter of approximately 1.0 $\mu$m. The mask 210 covers a cathode region 225 of the substrate 200 for the field emitter device. With mask 210 in place, an anodic etch is performed on the polysilicon layer 201 to produce porous polysilicon 202. The anodic etch may be formed using, for example, the techniques shown and described with respect to FIGS. 1–5 of copending application Ser. No. 08/948,372, entitled "Methods of Forming An Insulating Material Proximate A Substrate, and Methods of Forming An Insulating Material Between Components of An Integrated Circuit," filed on Oct. 9, 1997. The anodic etch is carried out in a hydrofluoric acid (HF). In one exemplary embodiment, the etching process is performed until more than 50% of the polysilicon is removed. In another embodiment, the etching process is performed until only approximately 25% of the polysilicon remains. The oxide masking layer 208 is also removed by the etch. The structure is now as it appears in FIG. 2B. As can be seen in FIG. 2B, the anodic etch does not form porous polysilicon 202 everywhere throughout the polysilicon layer 201. Instead, polysilicon cones 201 remain in the cathode region 225 of the substrate 200 protected by the mask 210.

Figure 2C:
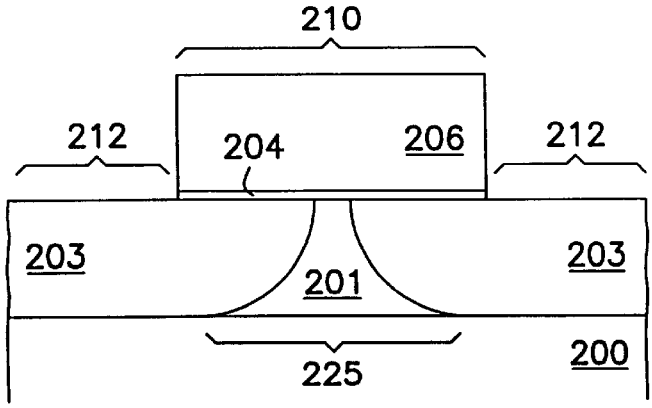

FIG. 2C illustrates the structure following the next series of fabrication steps. The porous polysilicon 202 is oxidized to produce a porous oxide layer 203. This oxidation process may be performed using, for example, the techniques shown and described with respect to FIGS. 1–5 of co-pending application Ser. No. 08/948,372, entitled "Methods of Forming An Insulating Material Proximate A Substrate, and Methods of Forming An Insulating Material Between Components of An Integrated Circuit," filed on Oct. 9, 1997. According to one embodiment prescribed in the co-pending application, the porous oxide layer 203 is produced by thermal oxidation of the porous polysilicon 202. In an alternative embodiment, a plasma assisted oxidation process, e.g., CVD, is used to form the porous oxide layer 203 from the porous polysilicon 202. This oxidation of the porous polysilicon 202 occurs rapidly and produces no significant volume increase. As will be understood by one of ordinary skill in the art, the oxide consumes the remaining polysilicon and partially fills the voids. Only the polysilicon cones 201, protected by the mask 210, remain un-oxidized in the cathode region 225 of the substrate 200. Thus, forming the polysilicon cone 201, or cathode 201, and the porous oxide layer 203 out of a single polysilicon layer 201 is achieved using one self-aligned process. The structure is now as it appears in FIG. 2C.

Figure 2D:
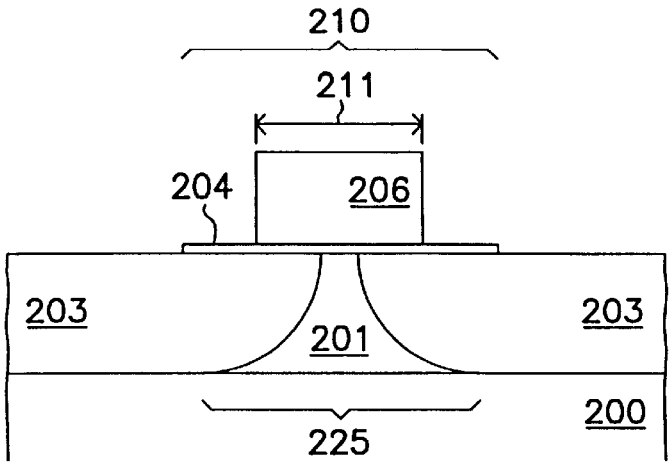

FIG. 2D illustrates the structure following the next sequence of processing steps. The nitride layer 206 is etched to reduce the thickness and size of the mask 210 from approximately 1 $\mu$m in diameter to approximately 0.5 $\mu$m in diameter. This etching process is carried out to reduce the thickness and size of the mask 210 to approximately one half of its previous size. The structure now appears as in FIG. 2D.

Figure 2E:
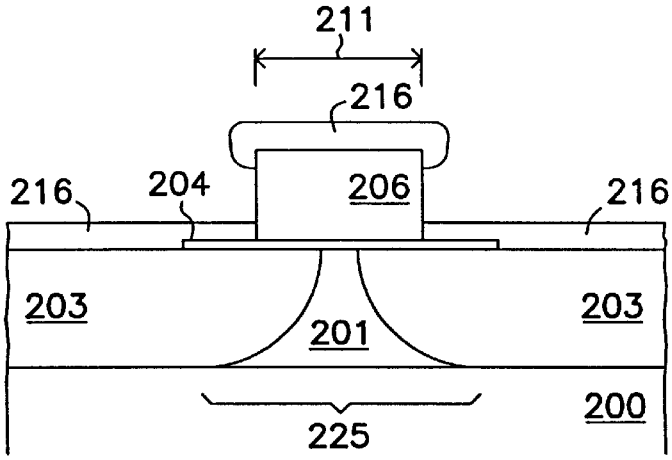

After the next sequence of processing steps, the structure appears as FIG. 2E. A gate material 216 is deposited over the nitride layer 206 and the porous oxide 203 using any suitable technique such as, for example, CVD. The gate material 216 is deposited to a thickness of approximately 0.25 $\mu$m. In one embodiment, the gate material 216 includes Molybdenum (Mo). In an alternate embodiment, the gate material 216 includes any suitable low work function material, e.g. other refractory metals. The structure is now as appears in FIG. 2E.

Figure 2F:
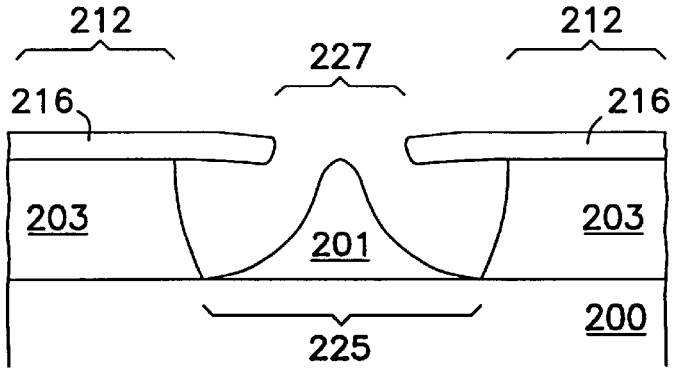

FIG. 2F illustrates the structure after the following sequence of fabrication steps. The remaining nitride layer 206 is removed using a RIE process. The removal of the nitride layer 206 provides a lift-off of the gate material 216 in the cathode region 225 and exposes the polysilicon cone 201. One of ordinary skill in the art of semiconductor processing will understand this lift-off technique. Next, using the gate material 216 as a mask for the oxide layer 204 and the porous oxide 203 are then etched away from the polysilicon cone 201. The etch is performed using any suitable technique such as, for example, RIE. This previous step leaves the polysilicon cone 201, or cathode 201, separated from the gate 216. The polysilicon cone is located in a cathode region 225 of the substrate 200, and the gate 216 and porous oxide layer 203 are located in an isolation region of the substrate 212. Hence, forming the polysilicon cone 201 and the gate 216 is similarly accomplished using a single self-aligned masking step. The structure is now as appears in FIG. 2F.

Figure 2G:
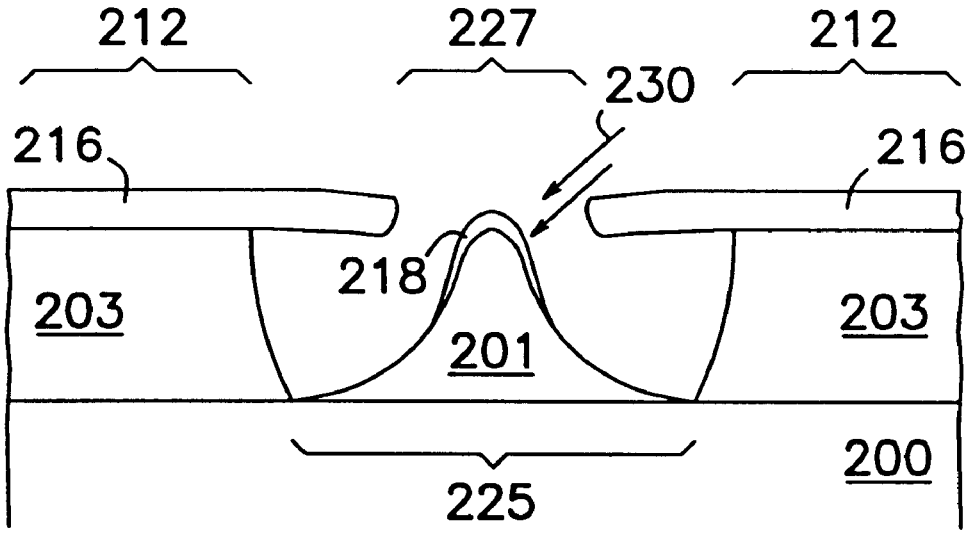

FIG. 2G illustrates a final optional processing step in the sequence of processing steps. FIG. 2G illustrates that a tip material 218 may be deposited on the polysilicon cone 201. In one exemplary embodiment, Molybdenum (Mo) is deposited, such as by CVD, on the polysilicon cone 201. The tip material is deposited at an incidence angle of approximately 45° as indicated by arrows 230. In another embodiment, any other suitable low work function or hard coating, e.g., diamond-like carbon, silicon carbide compounds, e.g. silicon oxycarbide, is deposited. The gate 216 defines an aperture 227 surrounding the polysilicon cone 201.

Figure 3A:
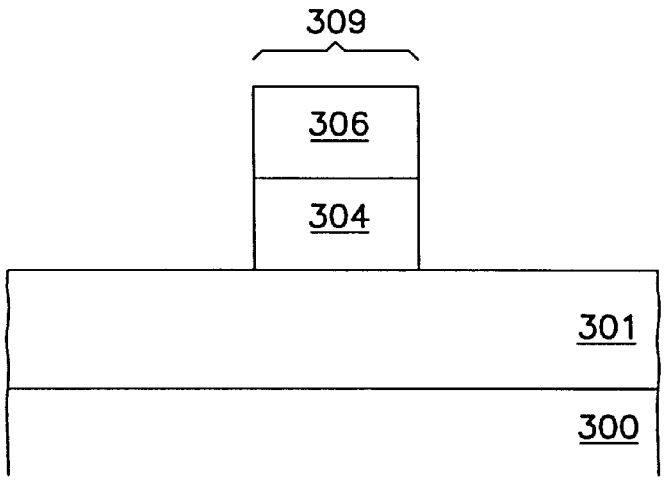
FIGS. 3A–3F illustrate another embodiment of a process of fabrication of a field emitter device according to the teachings of the present invention.

FIGS. 3A–3F illustrate an alternative embodiment of a process of fabrication for a field emitter device according to the teachings of the present invention. FIG. 3A illustrates the structure following the first series of processing steps. A polysilicon layer 301 is deposited over a large area substrate. The polysilicon layer 301 may be deposited using any suitable technique such as, for example, chemical vapor deposition (CVD). The polysilicon layer 301 is deposited to a thickness of approximately 1.0 micrometers ($\mu$m). The polysilicon layer 301 is then oxidized using a plasma assisted process, such as CVD, to form an oxide layer 304. A silicon nitride ($Si_3N_4$) layer 306 is deposited on the oxide layer 304 using any suitable process. Again, one suitable technique includes CVD. A photoresist is applied and exposed to form a mask. The composite nitride-oxide (NO) is then etched using any suitable technique such as, for example, reactive ion etching (RIE). This etching process produces a structure 309 which reflects the final pattern for a gate layer. The photoresist is then removed using conventional photoresist stripping techniques. The structure is now as appears in FIG. 3A.

Figure 3B:
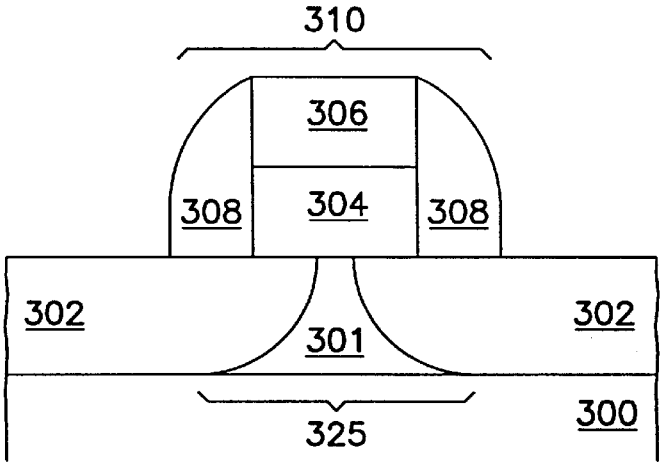

FIG. 3B illustrates the structure after the next sequence of fabrication steps. A second nitride layer 308 is deposited over nitride layer 306 of the structure 309 and the polysilicon layer 301. The second nitride layer 308 is deposited using a CVD process.

The composite nitride-nitride-oxide (NNO) is then directionally etched using any suitable technique such as, for example, reactive ion etching (RIE). This etching process leaves the second nitride layer 308 only on the sidewalls of the structure 309, but leaves enough width to continue to cover the region which is mask 310. The mask region 310 has a diameter of approximately 1.0 $\mu$m and covers a cathode region 325 on the substrate 300. The cathode region 325 is where the polysilicon field emitter structures are to be formed. With mask 310 in place, an anodic etch is performed to produce porous polysilicon 302. The anodic etch may be formed using, for example, the techniques shown and described with respect to FIGS. 1–5 of co-pending application Ser. No. 08/948,372, entitled "Methods of Forming An Insulating Material Proximate A Substrate, and Methods of Forming An Insulating Material Between Components of An Integrated Circuit," filed on Oct. 9, 1997. The anodic etch is carried out in a hydrofluoric acid (HF). In one exemplary embodiment, the etching process is performed until more than 50% of the polysilicon is removed. In another embodiment, the etching process is performed until only approximately 25% of the polysilicon remains. The structure is now as it appears in FIG. 3B. As can be seen in FIG. 3B, the anodic etch does not form porous polysilicon 302 everywhere throughout the polysilicon layer 301. Instead, polysilicon cones 301 remain in the cathode region of the substrate 300 protected by the mask 310.

Figure 3C:
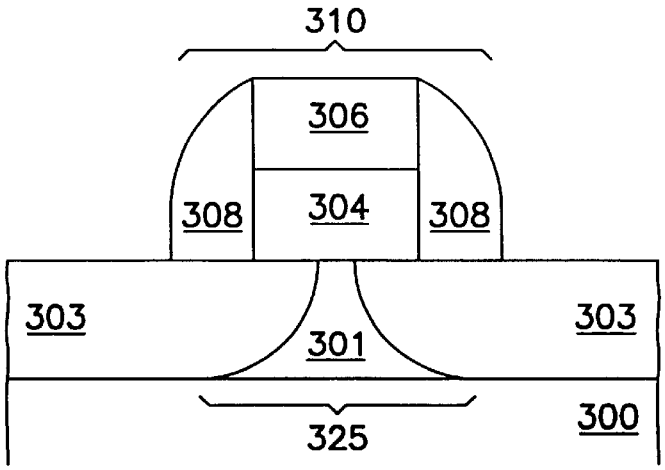

FIG. 3C illustrates the structure following the next series of fabrication steps. The porous polysilicon 302 is oxidized to produce a porous oxide layer 303. This oxidation process may be performed using, for example, the techniques shown and described with respect to FIGS. 1–5 of co-pending application Ser. No. 08/948,372, entitled "Methods of Forming An Insulating Material Proximate A Substrate, and Methods of Forming An Insulating Material Between Components of An Integrated Circuit," filed on Oct. 9, 1997. According to one embodiment prescribed in the co-pending application, the porous oxide layer 303 is produced by thermal oxidation of the porous polysilicon 302. In an alternative embodiment, a plasma assisted oxidation process, e.g., CVD, is used to form the porous oxide layer 303 from the porous polysilicon 302. This oxidation of the porous polysilicon 302 occurs rapidly and produces no significant volume increase. As will be understood by one of ordinary skill in the art, the oxide consumes the remaining polysilicon and partially fills the voids. Only the polysilicon cones 301, protected by the mask 310, remain un-oxidized in the cathode region of the substrate 300. Hence, forming the polysilicon cone 301, or cathode 301, and the porous oxide layer 303 out of a single polysilicon layer 301 is achieved using one self-aligned process. The structure is now as it appears in FIG. 3C.

Figure 3D:
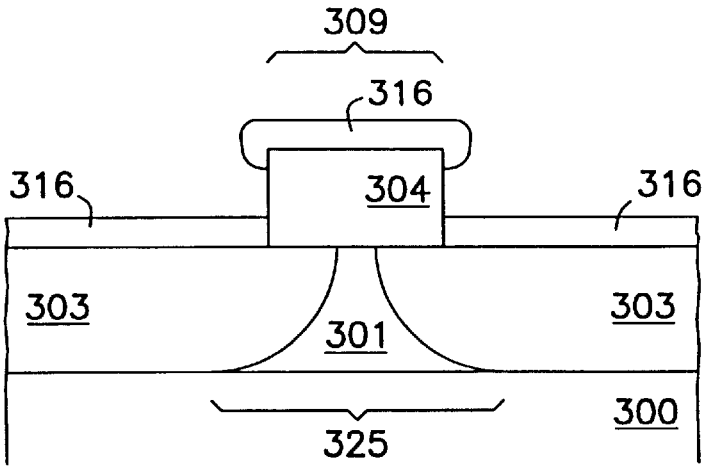

FIG. 3D illustrates the structure following the next sequence of processing steps. The nitride layers, 308 and 306 respectively, are removed from the top of the oxide layer 304 of the structure 309. The nitride layers, 308 and 306 respectively may be removed using any suitable etching technique such as, for example, RIE. A gate material 316 is deposited over the oxide layer 304 and the porous oxide 303 using any suitable technique such as, for example, CVD. The gate material 316 is deposited to a thickness of approximately 0.25 $\mu$m. In one embodiment, the gate material 316 includes Molybdenum (Mo). In an alternate embodiment, the gate material 316 includes any suitable low work function material, e.g. other refractory metals. The structure is now as appears in FIG. 3D.

Figure 3E:
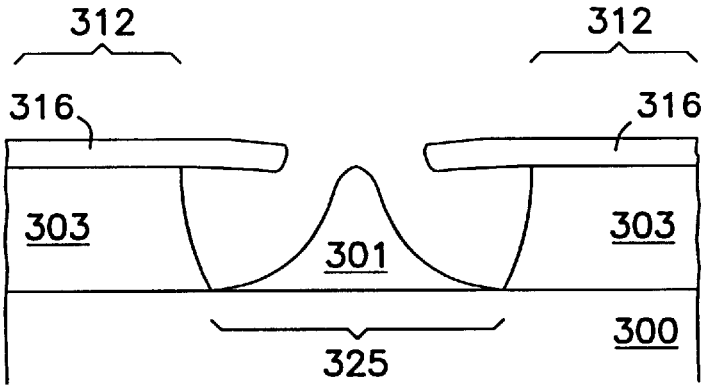

The remainder of the fabrication process then proceeds to completion according to the fabrication steps recited in connection with FIGS. 2F and 2G described above. The remaining oxide layer 306 is removed using a RIE process. The removal of the oxide layer 304 provides a lift-off of the gate material 316 in the cathode region 325 and exposes the polysilicon cone 301 as illustrated in FIG. 3E. One of ordinary skill in the art of semiconductor processing will understand this liftoff technique. Next, using the gate material 316 as a mask the porous oxide 303 is then etched away from the polysilicon cone 301. The etch is performed using any suitable technique such as, for example, RIE. This previous step leaves the polysilicon cone 301, or cathode 301, separated from the gate 316. The polysilicon cone is located in a cathode region 325 of the substrate 300, and the gate 316 and porous oxide layer 303 are located in an isolation region 312 of the substrate 300. Hence, forming the polysilicon cone 301 and the gate 316 is similarly accomplished using a single self-aligned masking step. The structure is now as appears in FIG. 3E.

Figure 3F:
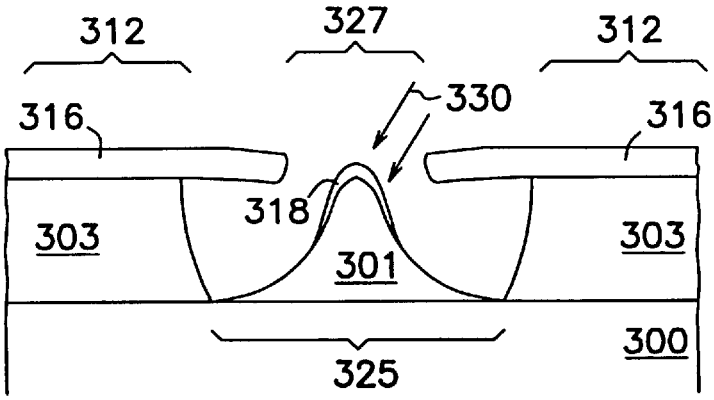

FIG. 3F illustrates a final optional processing step in the sequence of processing steps. FIG. 3F illustrates that a tip material 318 may be deposited on the polysilicon cone 301. In one exemplary embodiment, Molybdenum (Mo) is deposited, such as by CVD, on the polysilicon cone 301. The tip material is deposited at an incidence angle of approximately 45° as indicated by arrows 330. In another embodiment, any other suitable low work function or hard coating, e.g., diamond-like carbon, silicon carbide compounds, e.g. silicon oxycarbide, is deposited. The gate 316 defines an aperture 327 surrounding the polysilicon cone 301. In sum, the alternative fabrication method illustrated in FIGS. 3A–3F does not rely on reducing the thickness and dimensions of a gate pattern structure as performed in connection with FIG. 2D.

Figure 4:
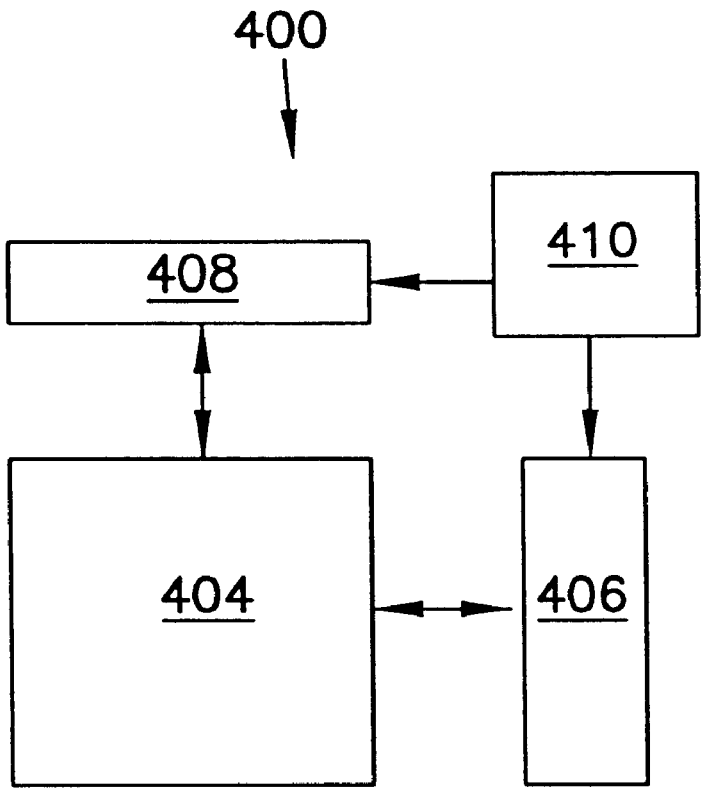
FIG. 4 is a block diagram which illustrates an embodiment of a flat panel display system according to the teachings of the present invention.

FIG. 4 is a block diagram which illustrates an embodiment of a flat panel display system 400 according to the teachings of the present invention. A flat panel display includes a field emitter array 404 formed on a glass substrate. The field emitter array system the field emitter array described and presented above in connection with FIG. 1. A row decoder 406 and a column decoder 408 each couple to the field emitter array 404 in order to selectively access the array. Further, a processor 410 is included which is adapted to receiving input signals and providing the input signals to address the row and column decoders, 406 and 408 respectively.

CONCLUSION

Thus, an improved method and structure are provided for simultaneous fabricating polysilicon cones for a field emitter and a porous insulating oxide layer for supporting a gate material. The porous insulating oxide is fabricated by first making the polysilicon porous in the field regions by an anodic etch and then oxidation. This is a fully self-aligned process and only one masking is used. Shaping of the gate material in close proximity to the top of the cone is achieved by a lift-off technique and requires no special deposition techniques like depositions at a grazing incidence to improve the emitter.

Although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention. It is to be understood that the above description is intended to be illustrative, and not restrictive. Combinations of the above embodiments, and other embodiments will be apparent to those of skill in the art upon reviewing the above description. The scope of the invention includes any other applications in which the above structures and fabrication methods are used. The scope of the invention should be determined with reference to the appended claims, along with the full scope of equivalents to which such claims are entitled.

What is claimed is:

1. A semiconductor field emitter device on a substrate, comprising:

a cathode formed in a cathode region of the substrate;

a gate insulator formed in an insulator region of the substrate, wherein the gate insulator and the cathode are formed from a single layer of polysilicon;

a gate formed on the gate insulator; and an anode opposing the cathode.

2. The semiconductor field emitter device of claim 1, wherein the cathode includes a polysilicon cone.

3. The semiconductor field emitter device of claim 2, wherein the cathode includes a metal silicide on the polysilicon cone.

4. The semiconductor field emitter device of claim 1, wherein the gate insulator includes a porous oxide layer.

5. The semiconductor field emitter device of claim 4, wherein the porous oxide layer is formed by performing an anodic etch on the single polysilicon layer in the insulator region to form porous polysilicon in the insulator region and then oxidizing the porous polysilicon.

6. The semiconductor field emitter device of claim 1, wherein the substrate includes silicon dioxide ($SiO_2$).

7. The semiconductor field emitter device of claim 1, wherein the substrate includes doped silicon material.

8. The semiconductor field emitter device of claim 1, wherein the cathode and the gate insulator are fabricated simultaneously.

9. The semiconductor field emitter device of claim 1, wherein the gate includes molybdenum (Mo).

10. The semiconductor field emitter device of claim 1, wherein the gate includes tungsten (W).

11. The semiconductor field emitter device of claim 1, wherein the gate includes titanium (Ti).

12. A field emitter device on a substrate, comprising:

a cathode formed in a cathode region of the substrate, wherein the cathode includes a polysilicon cone;

a porous oxide layer formed in an insulator region of the substrate, wherein the porous oxide layer and the polysilicon cone are formed from a single layer of polysilicon;

a gate formed on the porous oxide layer; and an anode opposing the cathode.

13. The field emitter device of claim 12, wherein the cathode and the gate insulator are fabricated simultaneously.

14. The field emitter device of claim 12, wherein the porous oxide layer is formed by performing an anodic etch on the single polysilicon layer in the insulator region to form porous polysilicon in the insulator region and then oxidizing the porous polysilicon.

15. The field emitter device of claim 12, wherein the cathode includes a metal silicide on the polysilicon cone.

16. The field emitter device of claim 12, wherein the substrate includes silicon dioxide ($SiO_2$).

17. The field emitter device of claim 12, where the gate includes a refractory metal.

18. A field emitter array, comprising:

a number of cathodes formed in rows along a substrate;

a gate insulator formed along the substrate and surrounding the cathodes, wherein gate insulator material and the cathodes are formed from a single layer of polysilicon;

a number of gate lines formed on the gate insulator; and a number of anodes formed in columns orthogonal to and opposing the rows of cathodes.

19. The field emitter array of claim 18, wherein the number of cathodes include polysilicon cones.

20. The field emitter array of claim 18, wherein the number of cathodes include metal silicides on the polysilicon cones.

21. The field emitter array of claim 18, wherein the gate insulator includes a porous oxide layer, wherein the porous oxide layer is formed by performing an anodic etch on portions of the single polysilicon layer to form porous polysilicon and then oxidizing the porous polysilicon.

22. The field emitter array of claim 18, wherein the substrate includes silicon dioxide ($SiO_2$).

23. The field emitter array of claim 18, wherein the number of cathodes and the gate insulator are fabricated simultaneously.

24. The field emitter array of claim 18, wherein the number of gate lines include refractory metals.

25. A flat panel display, comprising:

a field emitter array formed on a glass substrate, wherein the field emitter array includes:

a number of cathodes formed in rows along the substrate, wherein the number of cathodes include polysilicon cones;

a gate insulator formed along the substrate and surrounding the cathodes, wherein gate insulator material and the cathodes are formed from a single layer of polysilicon;

a number of gate lines formed on the gate insulator; and a number of anodes formed in columns orthogonal to and opposing the rows of cathodes, wherein the anodes include multiple phosphors, and wherein the intersection of the rows and columns form pixels;

a row decoder and a column decoder each coupled to the field emitter array in order to selectively access the pixels; and a processor adapted to receiving input signals and providing the input signals to the row and column decoders.

26. The flat panel display of claim 25, wherein the number of cathodes include metal silicides on the polysilicon cones.

27. The flat panel display of claim 25, wherein the gate insulator includes a porous oxide layer, wherein the porous oxide layer is formed by performing an anodic etch on portions of the single polysilicon layer to form porous polysilicon and then oxidizing the porous polysilicon.

28. The flat panel display of claim 25, wherein the number of gate lines include refractory metals.

* * * * *